US007942092B1

(12) United States Patent
Kiel et al.

(10) Patent No.: US 7,942,092 B1
(45) Date of Patent: May 17, 2011

(54) BLAST SHIELD FOR ARMORED VEHICLE

(75) Inventors: Thomas J. Kiel, Bernardsville, NJ (US); Allen T. Brokaw, Trenton, NJ (US); Frank Petrosillo, West Milford, NJ (US); Katrina A. Tubayan, Union, NJ (US); Matthew J. Hummers, Flanders, NJ (US); Ryan Hooke, Hopatcong, NJ (US); Kirk Deligiannis, Rockaway Park, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 333 days.

(21) Appl. No.: 12/185,278

(22) Filed: Aug. 4, 2008

(51) Int. Cl.
*F41H 5/20* (2006.01)
*F41H 7/02* (2006.01)

(52) U.S. Cl. ..... 89/36.13; 89/36.08; 89/905; 89/935

(58) Field of Classification Search ..... 89/36.07, 89/36.08, 36.09, 36.13, 36.14, 36.15
See application file for complete search history.

(56) References Cited

U.S. PATENT DOCUMENTS

| | | | | |
|---|---|---|---|---|
| 3,671,370 | A * | 6/1972 | Littell | 428/38 |
| 3,724,323 | A * | 4/1973 | Selle | 89/36.14 |
| 4,336,644 | A * | 6/1982 | Medlin | 29/401.1 |
| 4,934,246 | A * | 6/1990 | Benson et al. | 89/36.14 |
| 5,128,803 | A * | 7/1992 | Sprafke | 359/403 |
| 5,187,317 | A * | 2/1993 | Pellarin et al. | 89/36.14 |
| 5,315,915 | A * | 5/1994 | Sprafke | 89/36.14 |
| 5,452,641 | A * | 9/1995 | Kariya | 89/36.14 |
| 5,487,323 | A * | 1/1996 | Madden, Jr. | 89/36.08 |
| 7,478,580 | B1 * | 1/2009 | Parimi et al. | 89/36.13 |
| 7,823,498 | B2 * | 11/2010 | Schneider et al. | 89/36.08 |
| 2009/0120274 | A1 * | 5/2009 | Schneider et al. | 89/36.08 |

* cited by examiner

*Primary Examiner* — Bret Hayes
(74) *Attorney, Agent, or Firm* — John F. Moran

(57) ABSTRACT

A protective shield apparatus for a light armor vehicle having a turret includes a generally flat base plate mounted to the turret; an armor plate fixed to the base plate and including a front panel, a first side panel, a second side panel and a rear panel, the armor plate being canted vertically outward from the base plate; each of the first side panel, second side panel and rear panel including a ballistic glass window; a rear bracket connected at one end to a rear of the base plate and at another end to the turret; and a z-bracket connected at one end to the rear of the base plate and at another end the z-bracket bears against the turret.

20 Claims, 8 Drawing Sheets

BLAST SHIELD FOR ARMORED VEHICLE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to armored combat vehicles and in particular to blast shields for armored combat vehicles.

Light armored combat vehicles may include a rotating turret with one or more weapons mounted thereon. The turret may have two hatches, one for the gunner and one for the vehicle commander. Soldiers open the hatches to survey the surrounding landscape. The turrets generally do not have any armor above the level of the hatch opening, to protect the soldier's exposed upper body. Therefore, there is a need for protection when the soldier exposes the upper portion of his body above the hatch opening.

SUMMARY OF THE INVENTION

It is an object of the invention to provide a blast shield for light armored vehicles.

It is another object of the invention to provide a blast shield to protect a soldier's upper body.

One aspect of the invention is a protective shield apparatus for a light armor vehicle having a turret comprising a generally flat base plate mounted to the turret; an armor plate fixed to the base plate and including a front panel, a first side panel, a second side panel and a rear panel, the armor plate being canted vertically outward from the base plate; each of the first side panel, second side panel and rear panel including a ballistic glass window; a rear bracket connected at one end to a rear of the base plate and at another end to the turret; and a z-bracket connected at one end to the rear of the base plate and at another end the z-bracket bears against the turret.

Another aspect of the invention is a light armor vehicle comprising a turret with a front and a rear lifting eye; a generally flat base plate mounted to the turret; an armor plate fixed to the base plate and including a front panel, a first side panel, a second side panel and a rear panel, the armor plate being canted vertically outward from the base plate; each of the first side panel, second side panel and rear panel including a ballistic glass window; a rear bracket connected at one end to a rear of the base plate and at another end to the turret; and a z-bracket connected at one end to the rear of the base plate and at another end the z-bracket bears against the turret.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
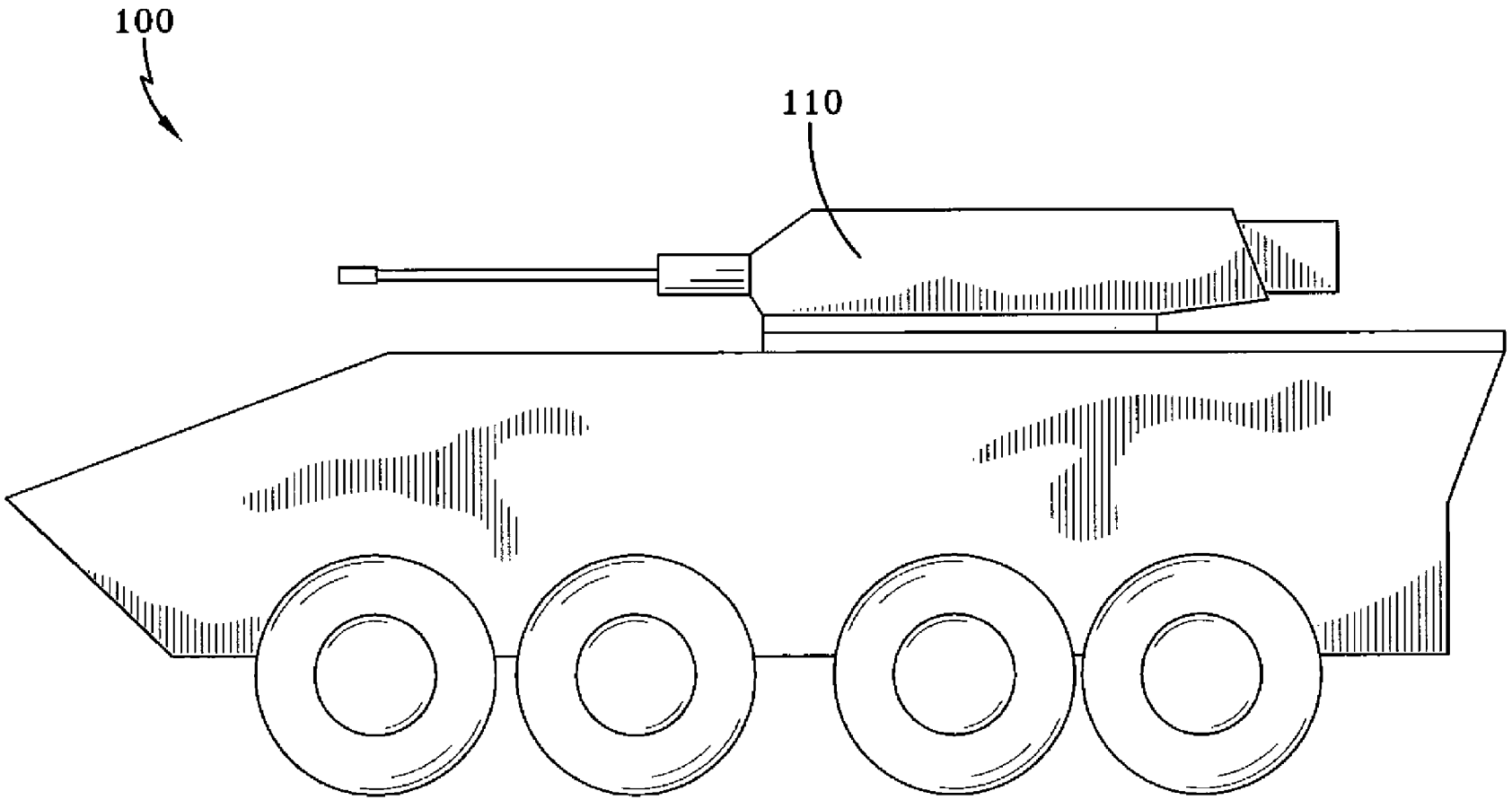
FIG-1 PRIOR ART
FIG. 1 is a side view of an exemplary light armored vehicle.
Figure 2:
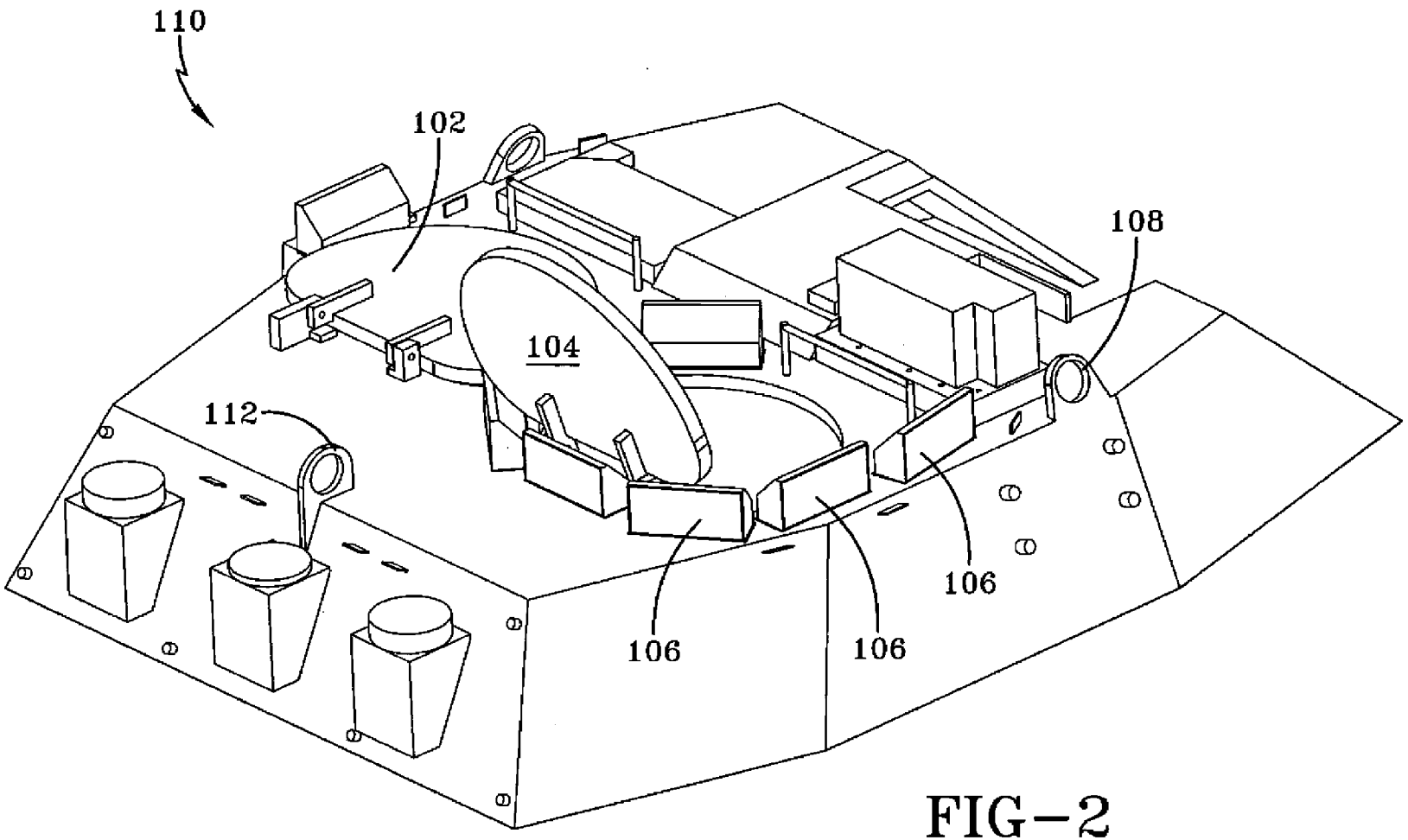
FIG-2 PRIOR ART
FIG. 2 is a perspective view of an exemplary turret for a light armored vehicle.

FIG. 1 is a side view of an exemplary light armored vehicle 100 having a turret 110. FIG. 2 is a perspective view of an exemplary turret 110. Turret 110 may include a gunner hatch 102 and a vehicle commander hatch 104. Surrounding the vehicle commander hatch 104 are a plurality of periscopes 106 that enable one to view the surroundings from inside the vehicle 100. The periscopes 106, however, offer a somewhat disjointed view. Therefore, the vehicle commander may prefer to open hatch 104 to obtain a full view of the landscape. Of course, the commander is then exposed to enemy threats, in particular, close-in, low-lying improvised explosive devices (IEDs).

Figure 3:
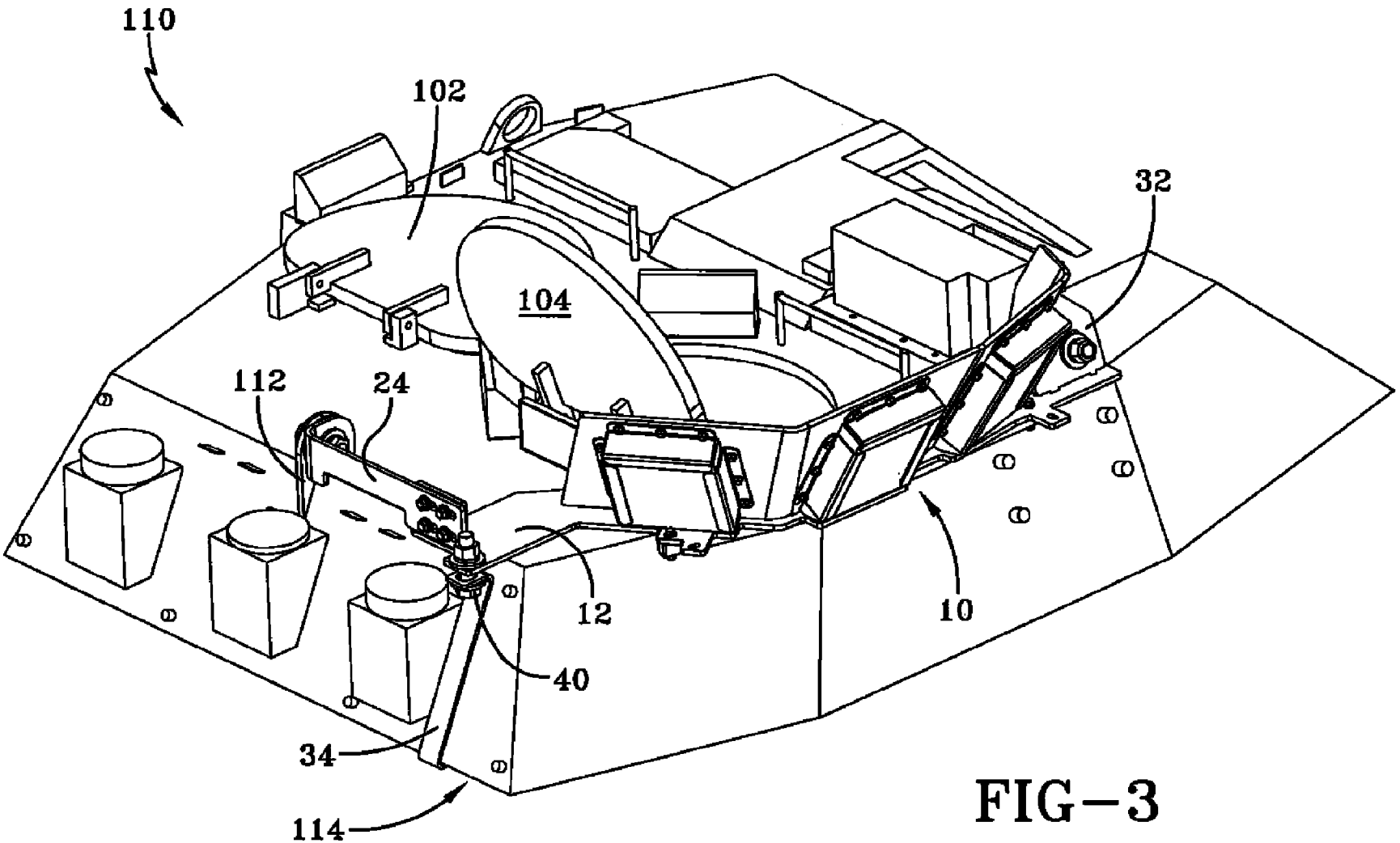
FIG. 3 is a perspective view of one embodiment of the invention mounted on the turret of FIG. 2.
Figure 4:
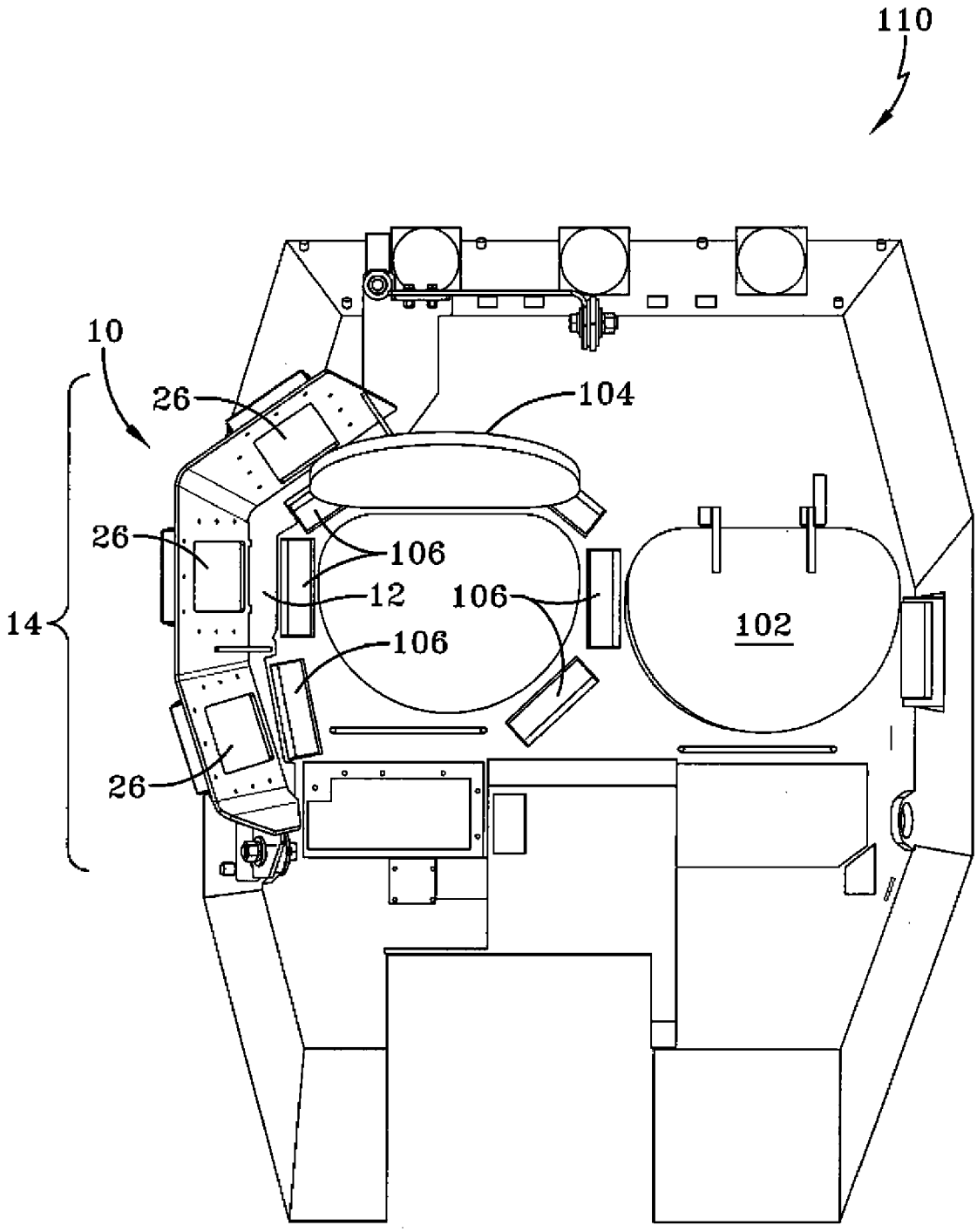
FIG. 4 is a top view of FIG. 3.

The invention is a modular protective device for armored vehicles. The invention has direct application to the vehicle commander hatch 104 of the Light Armored Vehicle (LAV) to protect the vehicle commander from small arms fire and fragmentation resulting from explosive devices. The invention mounts to the turret 110 of the LAV and other armored vehicles to provide front, side and rear protection. Transparent armor (ballistic glass windows) is utilized to provide visibility without compromising protection. The invention fully integrates with the Light Armored Vehicle (LAV-25) variant. The apparatus 10 (FIG. 3) is located on the right side of the turret 110 beside the vehicle commander hatch 104. FIG. 4 is a top view of FIG. 3.

Figure 5:
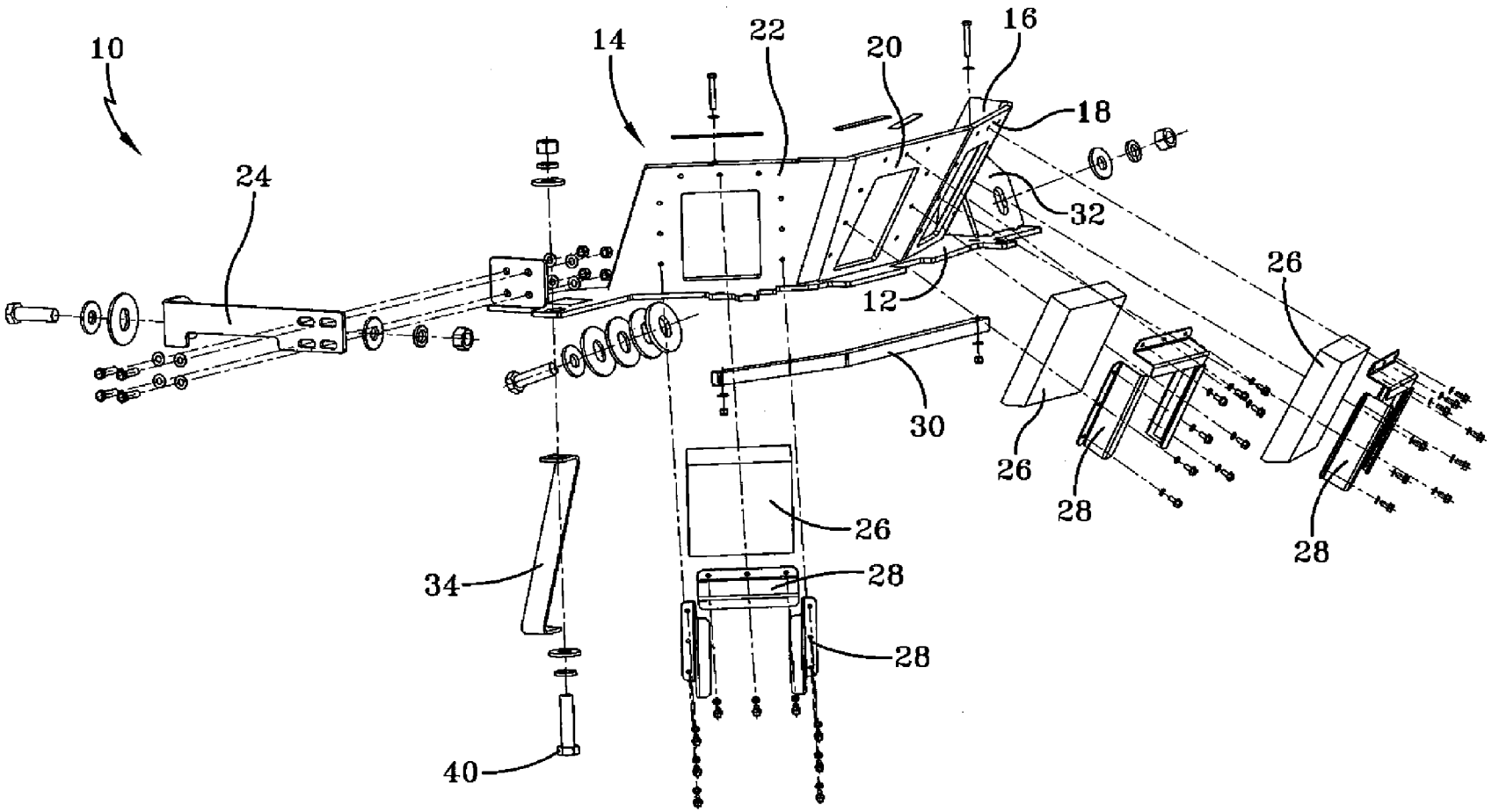
FIG. 5 is an exploded view of one embodiment of the invention, viewed from the right rear end of the vehicle.
Figure 6C:
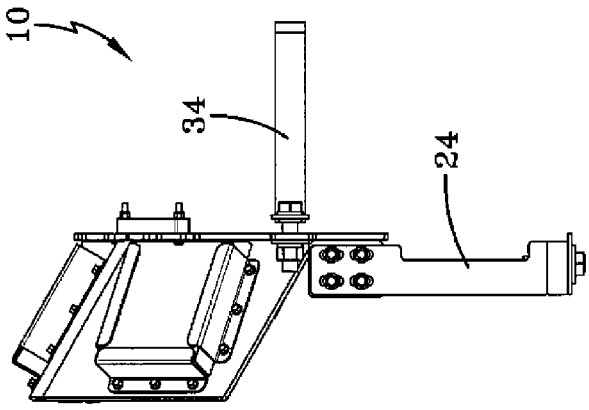
FIG. 6C is a right side view of FIG. 6A, looking from the rear of the vehicle.
Figure 6A:
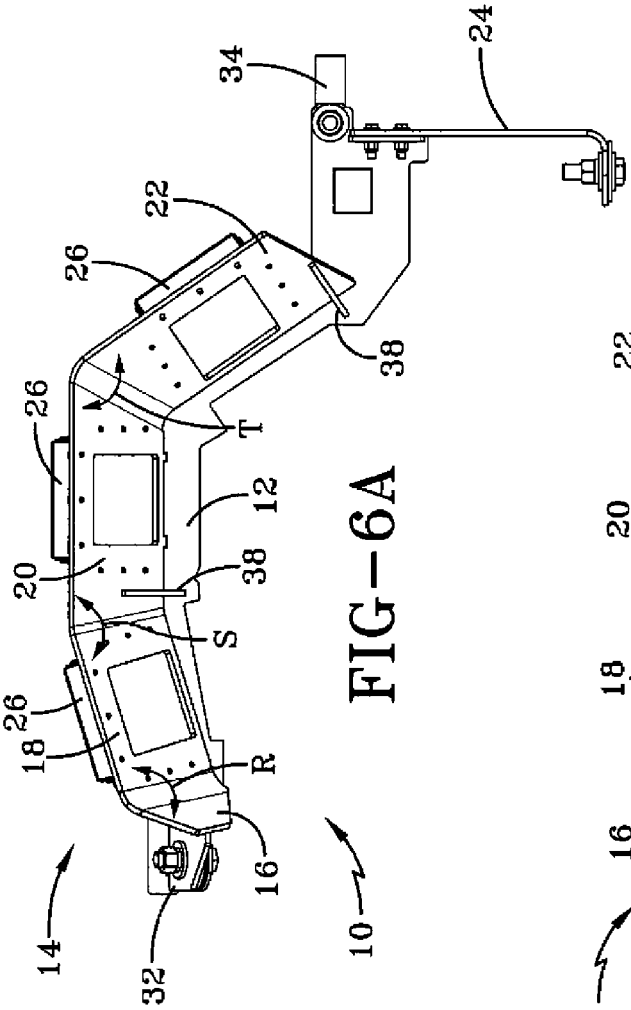
FIG. 6A is a top view of the embodiment of FIG. 5, with the rear of the vehicle being toward the right hand side of FIG. 6A.
Figure 6B:
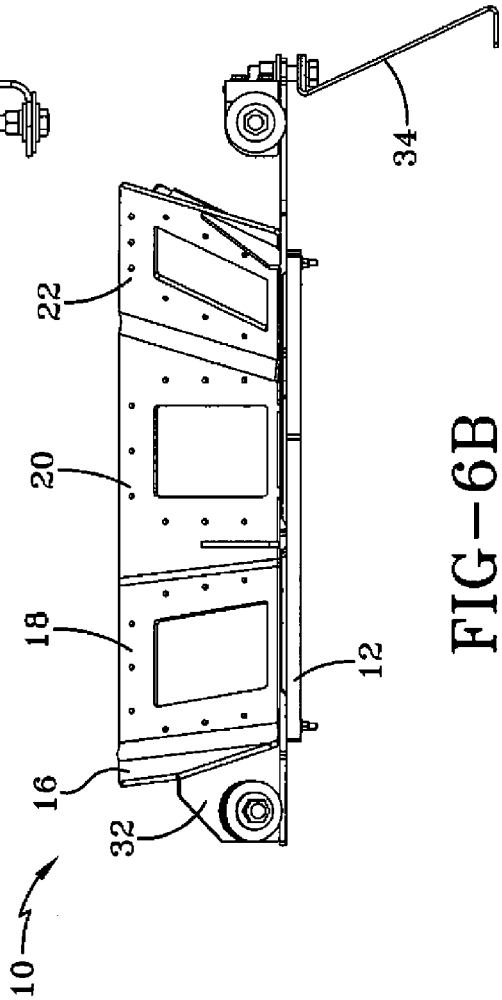
FIG. 6B is a front view of FIG. 6A, looking from the hatch to the right side of the vehicle.

FIG. 5 is an exploded view of one embodiment of a blast shield 10 in accordance with the invention, viewed from the right rear end of the vehicle 100. FIG. 6A is a top view of the blast shield 10 of FIG. 5, with the rear of the vehicle 100 being toward the right hand side of FIG. 6A. FIG. 6B is a front view of FIG. 6A, looking from the hatch 104 to the right side of the vehicle 100. FIG. 6C is a right side view of FIG. 6A, looking from the rear of the vehicle 100.

Referring to FIGS. 5 and 6A-C, the protective shield 10 comprises a generally flat base plate 12 mounted to the turret 110 and an armor plate 14 fixed to the base plate 12. The armor plate 14 includes a front panel 16, a first side panel 18, a second side panel 20 and a rear panel 22. Each of the first side panel 18, second side panel 20 and rear panel 22 include a ballistic glass (transparent armor) window 26. A rear bracket 24 is connected at one end to a rear of the base plate 12 and at another end to the turret 110. A Z-bracket 34 is connected at one end to the rear of the base plate 12 with an adjustable fastener, such as a cap screw 40. The other end of the Z-bracket 34 bears against the turret 110 (FIG. 3). FIG. 5 shows the skirt bar 30 that is fixed to the underside of the base plate 12 to provide protection in any open areas between the base plate 12 and the turret 110.

Figure 7:
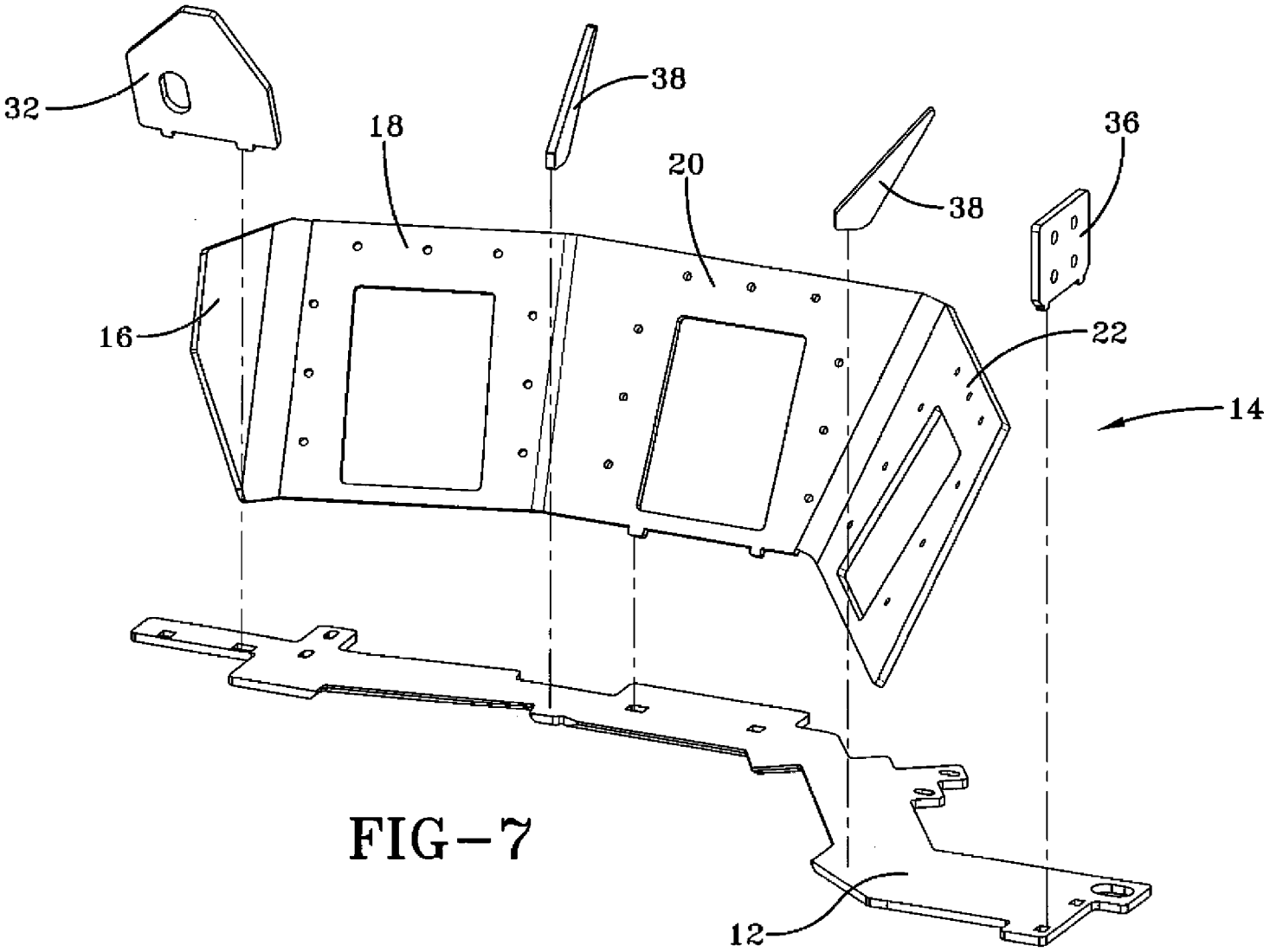
FIG. 7 is an exploded view of the base plate and the armor plate.

FIG. 7 is an exploded view of the base plate 12 and the armor plate 14. The base plate 12 includes a front eye plate 32 for connecting the base plate 12 to a lifting eye 108 (FIG. 2) of the turret 110. The base plate 12 includes a rear bracket mounting plate 36 for connecting the base plate 12 to the rear bracket 24 and the Z-bracket 34 (FIG. 3). The rear bracket 24 is fixed to a lifting eye 112 (FIG. 2) of the turret 110. The front eye plate 32 and rear bracket mounting plate 36 may be fixed to the base plate 12 by, for example, welding. A pair of generally triangular gussets 38 (FIG. 7) are fixed between the base plate 12 and the second side plate 20, and the base plate 12 and the rear plate 22.

The Z-bracket 34 clasps the underside 114 (FIG. 3) of the turret 110 and is bolted in tension to the base plate 12. The Z-bracket 34 further secures the base plate 12 to the turret 110 in the vertical direction. The Z-bracket 34 is secured to the base plate 12 with a fastener, such as a cap screw 40, in a manner to leave a gap between the upper surface of the Z-bracket 34 and the bottom surface of the base plate 14. The gap between the Z-bracket 34 and the base plate 14 allows the apparatus 10 to mount to any size turret within the expected variability of the LAV-25 system. The Z-bracket 34 is held in tension by tightening the cap screw 40 that holds the Z-bracket 34 toward the base plate 12.

As seen in FIG. 4, the armor plate 14 is canted outward from the vertical axis to provide additional protection against close threats while minimizing the amount of material used, which minimizes the weight of the apparatus 10. The amount of cant is in the range of about 10 degrees to about 40 degrees, preferably about 25 degrees. The armor plate 14 is configured and formed to provide the optimum angular geometry to maximize protective area. The material of the armor plate 14 may be, for example, aluminum, RHA Steel, High Hard Steel, titanium or composite laminate. The armor plate 14 is welded or fastened to the base plate 12. The base plate 12 is mounted flush against the top surface of the turret 110. The base plate 12 is configured to avoid contact with the vehicle commander station periscopes 106 located on the top of the turret 110.

Referring to FIG. 6A, each panel 16, 18, 20, 22 of the armor plate 14 is angled with respect to its adjacent plate. An angle R between the front panel 16 and the first side panel 18 is in the range of about 120 to about 140 degrees and preferably about 128 degrees; an angle S between the first side panel 18 and the second side panel 20 is in the range of about 155 to about 175 degrees and preferably about 165 degrees; and an angle T between the second side panel 20 and the rear panel 22 is in the range of about 125 to about 150 degrees and preferably about 138 degrees. At the joints between the panels 16, 18, 20, 22, each panel is about twelve inches high. Rear panel 22 is about fifteen inches wide, second side panel 20 is about twelve inches wide at the bottom and about fifteen inches wide at the top, first side panel 18 is about twelve inches wide, and front panel 16 varies in width to accommodate other components present on the turret 110.

Usage of the periscopes 106 (FIG. 4) is maintained by positioning the transparent armor windows 26 in the field of view of the periscopes 106. Therefore, a view through the periscopes 106 proceeds through the transparent armor windows 26 for a clear view of the surroundings. The periscopes 106 are operated from inside the vehicle 100. The apparatus 10 is applicable to both hatches 102, 104 of the turret 110 through proper adjustment of the geometry for attachment purposes. The apparatus 10 is also applicable to other variants of the LAV, as well as other light and heavy armored vehicles outside of the LAV Family of Vehicles.

Figure 8A:
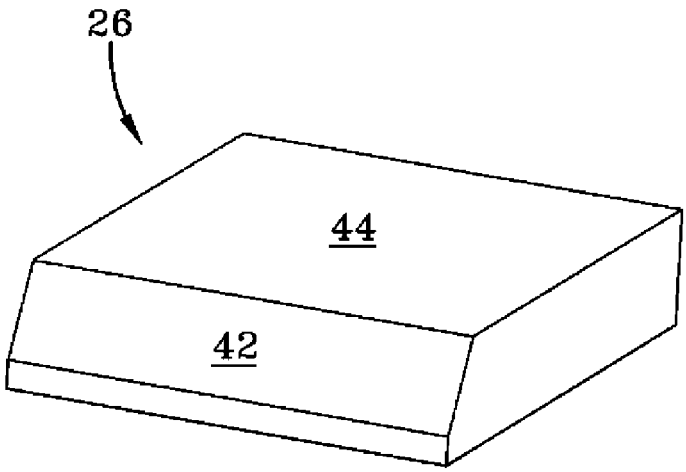
FIG. 8A is a perspective view and FIG. 8B is a side view of a window.
Figure 8B:
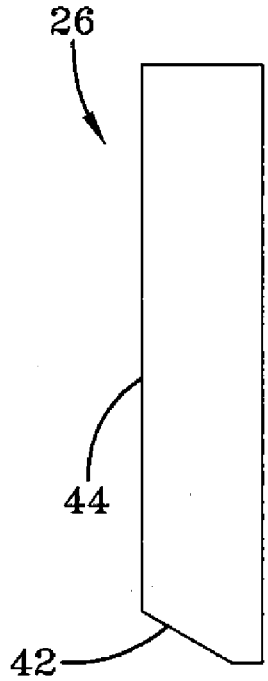
Figure 9:
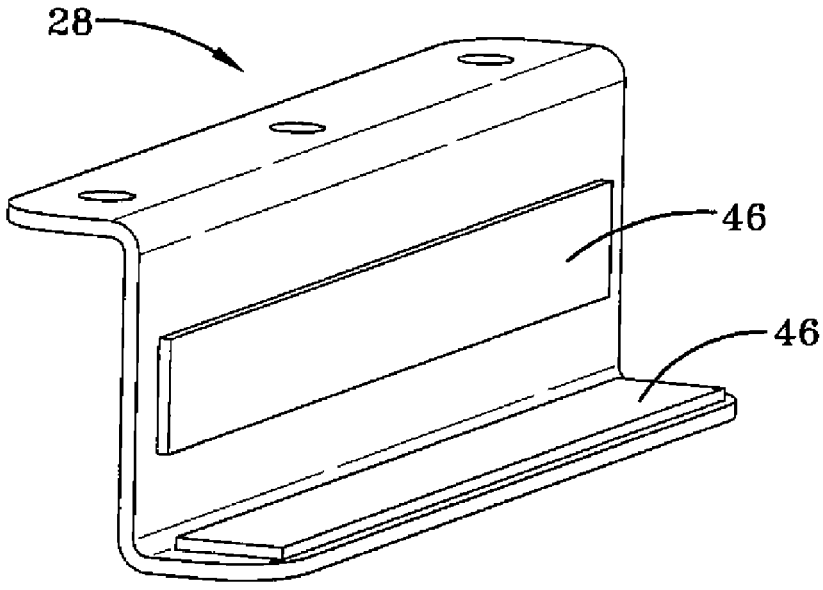
FIG. 9 is a perspective view of a window bracket.

FIG. 8A is a perspective view and FIG. 8B is a side view of a transparent armor window 26. The transparent armor windows 26 comprise, for example, laminated annealed glass, polycarbonate, polyurethane, poly vinyl butyral, and/or ceramics. The windows 26 are configured to mount at the same angle as the armor plate 14. A beveled edge 42 is required to position the glass 26 against the armor plate 14 while allowing the glass to be lowered flush against the base plate 12. Surface 44 is the exterior or strike face of the window 26. The beveled edge 42 abuts the base plate 12. The position of the glass 26 against the base plate 12 is required to fully utilize the visibility offered by the periscopes 106 and to minimize any ballistic gaps that may constitute areas of vulnerability. Three identical brackets 28 (FIGS. 5 and 9) are used to mount the transparent armor window 26 flush against the armor plate 14. Gaskets 46 (FIG. 9) are placed between the brackets 28 and the glass 26. The outward canting of the armor plate 14 helps to deflect projectile threats more effectively and minimizes the effects of blast overpressure. The transparent armor windows 26 are mounted on the outer surface of the armor plate 14. The windows are about eight inches wide and about ten inches tall.

For the LAV-25, the apparatus 10 is modular in that existing attachment points on the gun turret 110 are utilized to mount the apparatus 10. Standard fastening hardware may be utilized and no welding, drilling or special tools are required to attach the apparatus 10 to the LAV-25. The apparatus 10 uniquely mounts to the right and rear lifting eyes 108, 112 of the turret 110. A third mount is established through the use of the Z-bracket 34.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A protective shield apparatus for a light armor vehicle having a turret, comprising:

a generally flat base plate mounted to the turret;

an armor plate fixed to the base plate and including a front panel, a first side panel, a second side panel and a rear panel, the armor plate being canted vertically outward from the base plate;

each of the first side panel, second side panel and rear panel including a ballistic glass window;

a rear bracket connected at one end to a rear of the base plate and at another end to the turret; and a z-bracket connected at one end to the rear of the base plate and at another end the z-bracket bears against the turret.

2. The apparatus of claim 1 wherein the base plate includes a front eye plate for connecting the base plate to the turret.

3. The apparatus of claim 1 wherein the base plate includes a rear bracket mounting plate for connecting the base plate to the rear bracket and the z-bracket.

4. The apparatus of claim 1 wherein the rear bracket and the front eye plate are connected to lifting eyes of the turret.

5. The apparatus of claim 1 further comprising a skirt bar connected to an underside of the base plate.

6. The apparatus of claim 1 wherein an angle between the front panel and the first side panel is in a range of about 120 to about 140 degrees.

7. The apparatus of claim 1 wherein an angle between the first side panel and the second side panel is in a range of about 155 to about 175 degrees.

8. The apparatus of claim 1 wherein an angle between the second side panel and the rear panel is in a range of about 125 to about 150 degrees.

9. The apparatus of claim 1 further comprising a pair of generally triangular gussets fixed between the base plate and the second side plate, and the base plate and the rear plate.

10. The apparatus of claim 1 wherein the armor plate is canted at an angle in the range of about 10 degrees to about 40 degrees, with respect to vertical.

11. A light armor vehicle, comprising:

a turret with a front and a rear lifting eye;

a generally flat base plate mounted to the turret;

an armor plate fixed to the base plate and including a front panel, a first side panel, a second side panel and a rear panel, the armor plate being canted vertically outward from the base plate;

each of the first side panel, second side panel and rear panel including a ballistic glass window;

a rear bracket connected at one end to a rear of the base plate and at another end to the turret; and a z-bracket connected at one end to the rear of the base plate and at another end the z-bracket bears against the turret.

12. The vehicle of claim 11 wherein the base plate includes a front eye plate for connecting the base plate to the turret.

13. The vehicle of claim 11 wherein the base plate includes a rear bracket mounting plate for connecting the base plate to the rear bracket and the z-bracket.

14. The vehicle of claim 11 wherein the rear bracket and the front eye plate are connected to the rear and the front lifting eyes, respectively.

15. The vehicle of claim 11 further comprising a skirt bar connected to an underside of the base plate.

16. The vehicle of claim 11 wherein an angle between the front panel and the first side panel is in a range of about 120 to about 140 degrees.

17. The vehicle of claim 11 wherein an angle between the first side panel and the second side panel is in a range of about 155 to about 175 degrees.

18. The vehicle of claim 11 wherein an angle between the second side panel and the rear panel is in a range of about 125 to about 150 degrees.

19. The vehicle of claim 11 further comprising a pair of generally triangular gussets fixed between the base plate and the second side plate, and the base plate and the rear plate.

20. The vehicle of claim 11 wherein the armor plate is canted at an angle in the range of about 10 degrees to about 40 degrees, with respect to vertical.

* * * * *